US005314135A

United States Patent [19]

Forrest, Jr. et al.

[11] Patent Number: 5,314,135

[45] Date of Patent: May 24, 1994

[54] EXPANDABLE MANDREL

[75] Inventors: Albert W. Forrest, Jr., Chillicothe; Mark R. Jones, Reynoldsburg, both of Ohio

[73] Assignee: E. I. du Pont de Nemours and Company, Wilmington, Del.

[21] Appl. No.: 748,223

[22] Filed: Aug. 12, 1991

[51] Int. Cl.[5] ..... B65H 75/18

[52] U.S. Cl. ..... 242/72.1; 269/48.1

[58] Field of Search ..... 242/72.1, 72 R, 73; 72/478; 279/2.1, 2.11, 2.12; 269/48.1, 48.3

[56] References Cited

U.S. PATENT DOCUMENTS

| | | | |
|---|---|---|---|
| 1,627,729 | 5/1927 | Dingee | 242/72.1 |
| 2,293,085 | 8/1942 | Stieber | 279/2.12 X |
| 2,890,001 | 6/1959 | Triquet | 242/72.1 |
| 3,031,995 | 5/1962 | Taylor, Jr. | 269/48.1 |
| 3,990,690 | 11/1976 | Lick | 269/48.1 |
| 4,067,511 | 1/1978 | Hermanns | 242/72.1 |
| 4,142,690 | 3/1979 | Karle et al. | 242/72.1 X |
| 4,436,574 | 3/1984 | Long et al. | 242/72.1 X |
| 4,492,346 | 1/1985 | Young | 242/72.1 |
| 4,600,334 | 7/1986 | Sousloff | 242/72.1 X |
| 4,694,559 | 9/1987 | Lundy et al. | 242/72.1 X |
| 4,715,551 | 12/1987 | Besemann | 242/72.1 X |
| 4,867,671 | 9/1989 | Nagayoshi et al. | 242/72.1 X |

FOREIGN PATENT DOCUMENTS

| | | | |
|---|---|---|---|
| 632531 | 11/1949 | United Kingdom . | |
| 855511 | 12/1960 | United Kingdom | 242/72.1 |
| 1166212 | 10/1969 | United Kingdom . | |

*Primary Examiner*—Daniel P. Stodola
*Assistant Examiner*—John Rollins

[57] ABSTRACT

An expandable mandrel for mounting a core for winding, in which inner elements are moved inwardly by a floating screw to cam outer elements outwardly to grip the core. The screw is not fixed in the axial direction. Each of the inner elements has a tapered surface slidably positioned in operative relationship with an opposed tapered surface on each of the outer elements. As the inner elements move inwardly the sliding contact of these tapered surfaces cam the outer elements into gripping contact with the inner surface of the core.

6 Claims, 4 Drawing Sheets

EXPANDABLE MANDREL

BACKGROUND OF THE INVENTION

1. Field of the Invention

The field of art to which this invention pertains is mandrels or core gripping devices, and more particularly, it is directed to a radially expandable mandrel for mounting a core for winding a web of sheet material, such as paper or plastic film.

2. Description of the Related Art

Mandrels, which can be expanded radially to grip a core for winding a web of material, are known to the art.

Various mechanical and pneumatic means have been used to expand this type of mandrel into its core gripping position. A typical example is seen in U.S. Pat. No. 2,890,001 to Triquet which discloses an expanding core shaft for gripping the inside of a paper core. In such patent, the core shaft is assembled into a roll of paper with its expansion element or sleeve radially collapsed between a spaced cone and the conical end of an operating member so that the core shaft slides easily into the core of the roll. After the core shaft is properly located in the end of the roll, an operating shaft is rotated to drive the operating member axially outwardly along an inner tube. The relatively low pitch of the conical surfaces on the expansion sleeve and operating member respectively permit the operating member to slide in expanding relation into the inner end of the expansion sleeve while the relatively high pitch of the cone and its tapered surface resist axial movement of the expansion sleeve. As the inner end of the expansion sleeve expands and grips the inside of the core, further expansion of the inner end of the core sleeve is obstructed and continued outward motion of the operating member causes the expansion sleeve to move axially outwardly in expanding relation over the cone until both ends of the expansion sleeve are formally engaged within the inside of the roll core.

This expandable core shaft provides an effective means for gripping the core during winding. However, the gripping of the core does not occur in a uniform manner; the inner end of the sleeve expands and contacts the inner surface of the core before the outer end makes gripping contact. This uneven force, at the time of contact, could cause axial displacement of the core during mounting. Further, the mechanical means used to expand the shaft in this patent are fairly complex, when compared to the mandrel of the instant invention in which uniform contact of the expanding elements which grip the core is more easily obtained.

The instant invention solves this problem of lack of uniform contact with the core during the gripping operation by providing a mandrel with expandable outer spring-like elements which are cammed outwardly in a uniform manner into gripping contact with the inner surface of the core. These outer elements are restricted axially and their surfaces remain in a substantially horizontal plane during radial movement and during contact with the core. This controlled contact prevents axial displacement of the core which might be caused by uneven contact.

U.S. Pat. No. 4,492,346 shows an example of an expandable shaft in which camming action is used to move a plurality of core engagers into engagement with a core. A positive force is also provided to retract the core-engagers which may have become embedded in the surrounding core. Each of the engagers is an integral metal unit that includes a number of spaced core engaging lugs on its outer surface.

As compared to the teachings of this patent, the camming movement, of the outer elements, in the mandrel of this invention, is accomplished in a relatively uncomplex manner by moving spaced apart inner elements of the mandrel inwardly, toward each other, under the outer elements. These elements have matching tapered surfaces which provide the camming action. Again since only the inner elements are moved axially and since such elements never contact the core, core displacement caused by axial movement, due to contact during mounting, is prevented.

A unique means is also provided to simultaneously move the inner elements axially inwardly to thereby radially move the outer elements into uniform gripping contact with the core. This means is in the form of a floating acme screw, which will further be described in detail. Such screw additionally assures that uniform equal gripping forces are placed against the core surface by each of the outer elements, irrespective of diameter variations in the core. This feature plays a significant role in providing improved runout of the core surface.

By providing these and other advantages, the expandable mandrel of this invention gives to the art an improved means of mounting cores for winding, and in so doing provides improved properties in the wound roll.

SUMMARY OF THE INVENTION

Briefly described, this invention is a mandrel for mounting a tubular core for winding a web of sheet material.

Such mandrel has at least two matching pairs of inner and outer tapered elements positioned in spaced relationship with each other on the outer surface of a tube. Each of the inner elements has a first cylindrical inner surface and a second tapered outer surface, with such first inner surfaces being positioned in slidable contact with the outer cylindrical surface of the tube. The outer elements have first cylindrical outer surfaces and second tapered inner surfaces which are positioned in operative relationship with the second tapered surfaces of the inner elements. The outer elements are adapted to be expanded outwardly whereby their outer cylindrical surfaces uniformly contact and grip, with substantially equal force, the inner cylindrical surface of the core.

Means are provided for connecting the inner and outer tapered elements to the tube and for restricting the axial and rotational movement of the outer elements with respect to the tube. Means are also provided for moving the inner elements axially inwardly, simultaneously, toward each other whereby sliding contact of the tapered outer surfaces of such inner elements with the tapered inner surfaces of the outer elements expands the outer elements radially outwardly and thereby move their cylindrical outer surfaces into contact with the inner surface of the core whereby to grip and mount the core for winding.

In an important aspect of this invention, the means for moving the inner elements inwardly toward each other is in the form of a floating acme screw. Such screw has a through shaft and right hand threads at one end and left hand threads at the other end. A first acme nut is positioned on the right hand threads and a second acme nut positioned on the left hand threads. The first nut is connected to one of the inner elements and the second nut is connected to the other inner element whereby when the screw is rotated in one direction, the spaced apart inner elements are moved simultaneously axially toward each other thereby expanding the outer elements radially outwardly into gripping contact with the inner surface of the core.

The angle of taper of the second outer surfaces of the inner tapered elements which abut and are in slidable contact with the second inner surfaces of the outer tapered elements, is less than 45°. At such an angle the outer expandable spring-like elements are cammed outwardly uniformly with their cylindrical outer surfaces remaining in a substantially horizontal plane during movement and during contact with the inner surface of the core.

Preferably the angle of taper of the second outer surfaces of the inner tapered elements in slidable contact with the second inner surfaces of the outer tapered elements is less than 20°. At this angle the outer elements will be cammed outwardly uniformly during movement and during contact with the inner surface of the tube and the frictional contact of the respective surfaces, at such angle, will lock the inner and outer elements in position, axially.

The floating acme screw, which provides substantially equal gripping forces by each of the outer elements with the core also provides an additional locking force for maintaining the inner and outer elements in their axial position during a web winding operation.

When the acme screw is rotated in the other direction, the spaced-apart inner elements will move outwardly axially away from each other to release the gripping force of the outer elements with the core. Such elements spring inwardly radially into inoperative positions so that the mandrel can be removed from the core after completion of the winding operation.

DESCRIPTION OF THE PREFERRED EMBODIMENT

This invention is an expandable mandrel for mounting a core for winding a web of material.

Figure 1:
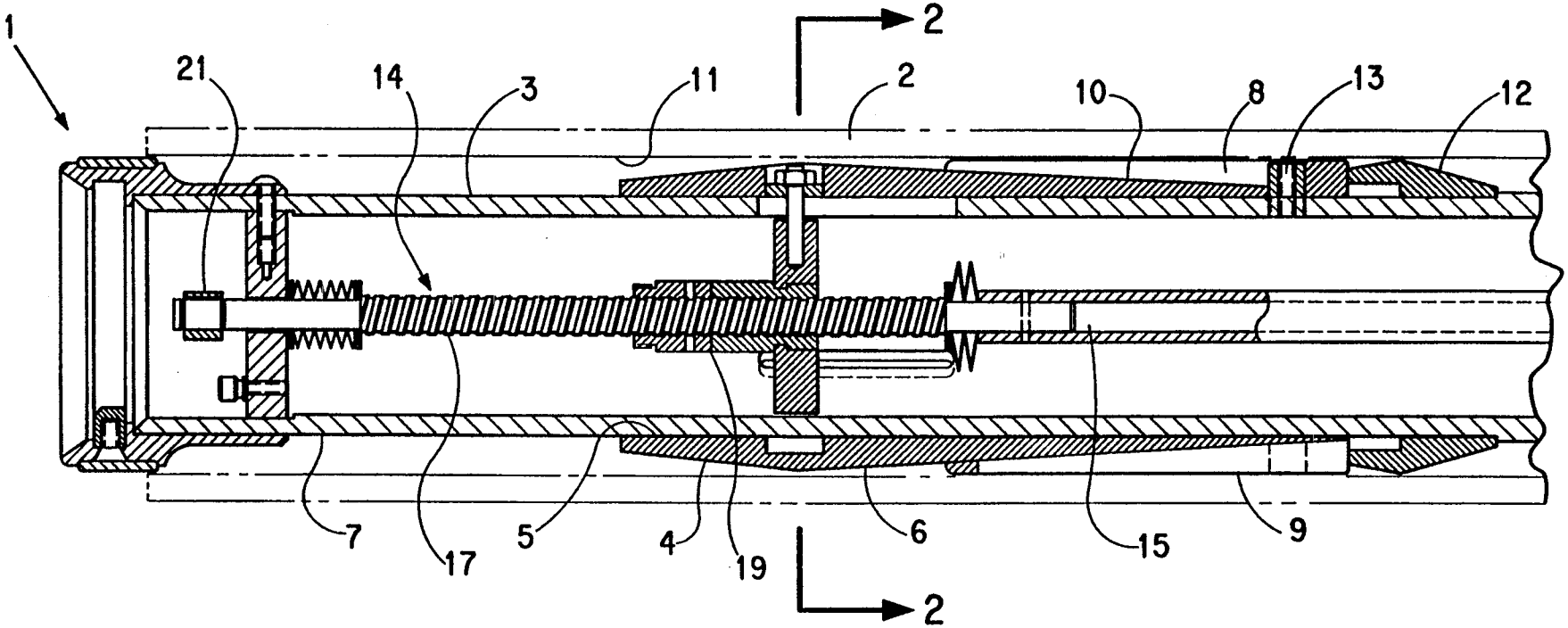
FIGS. 1 and 1A are cross-sectional views showing a mandrel in accordance with this invention.
Figure 1A:
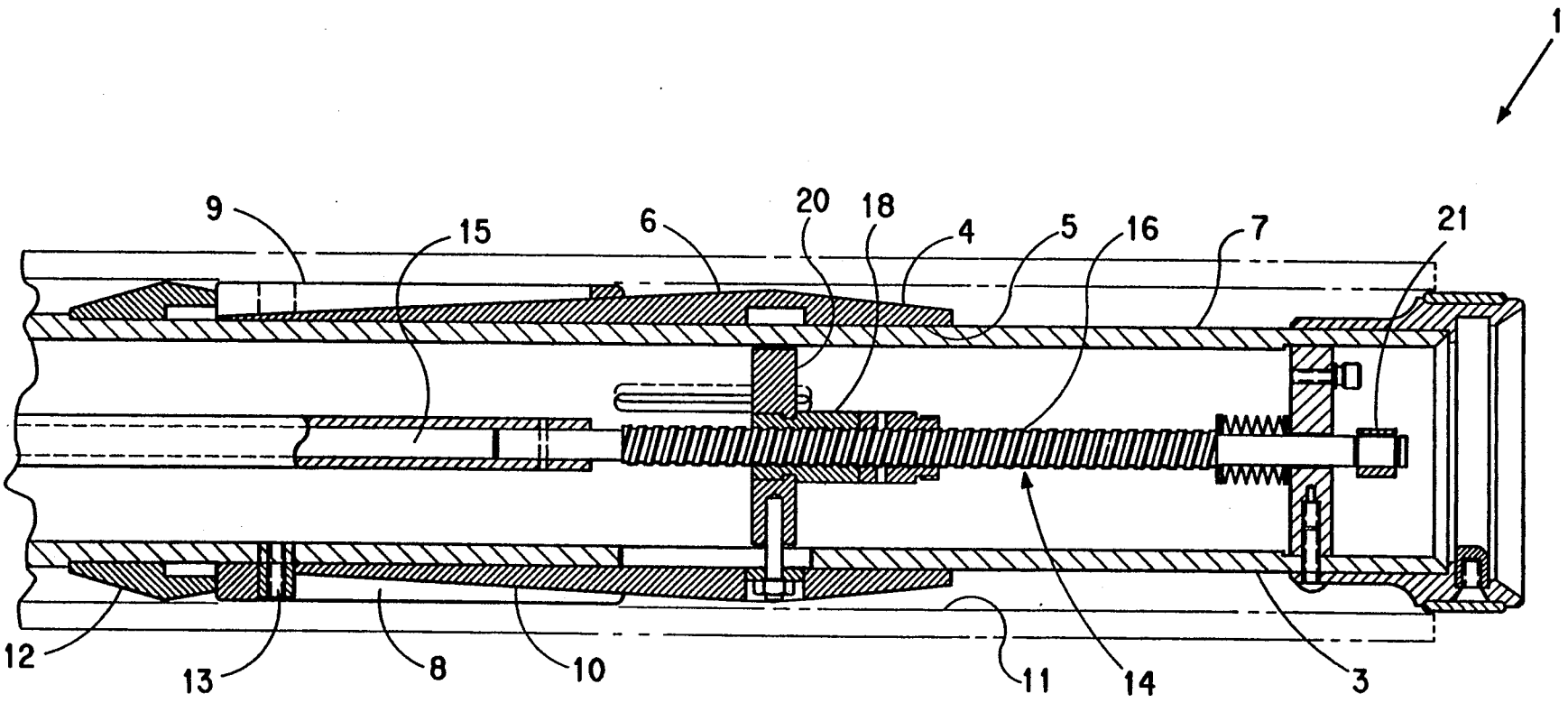
Figure 2:
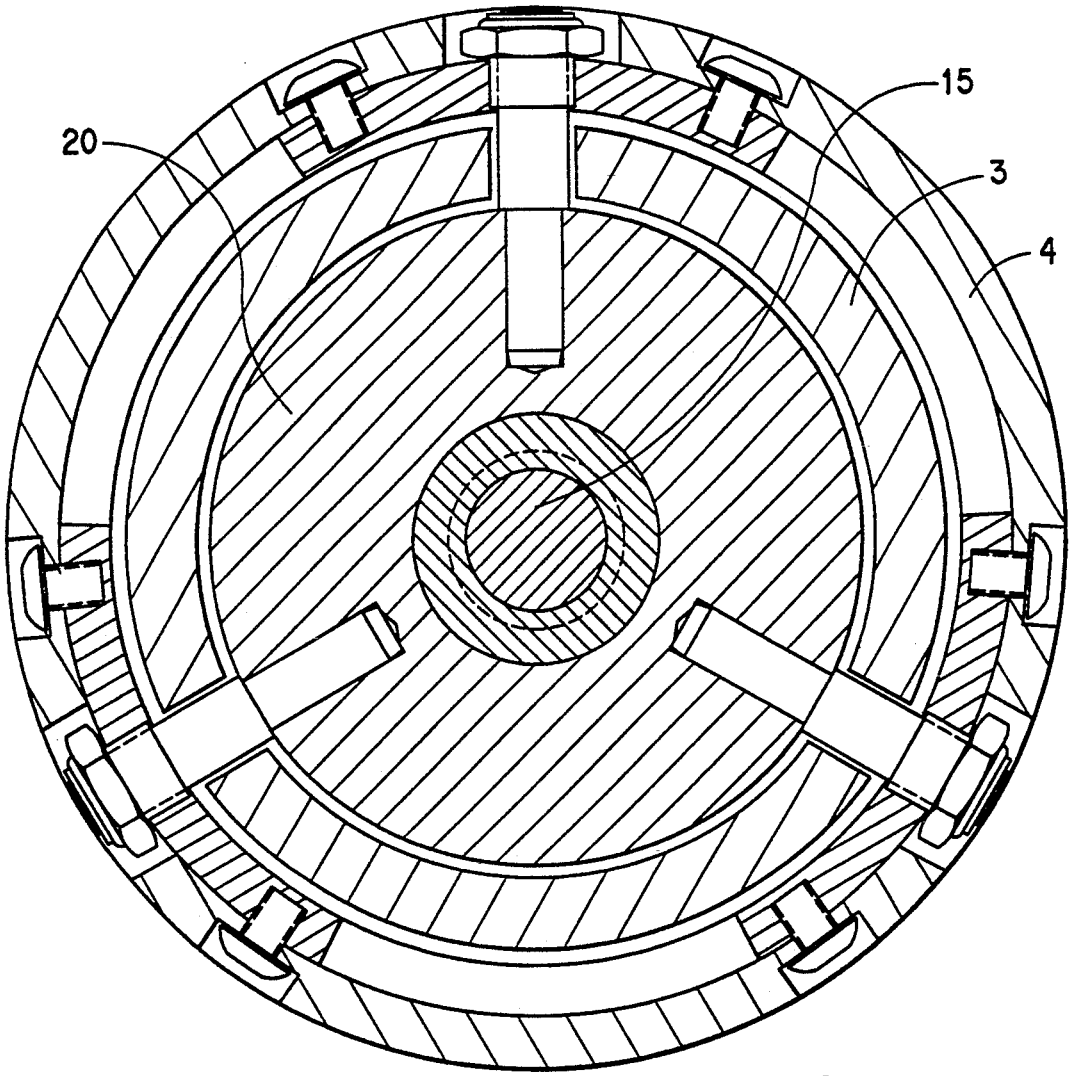
FIG. 2 is a cross-sectional enlarged view taken along lines A—A of FIG. 1.

As best seen in FIG. 1, this mandrel, generally designated 1 is adapted to be inserted into a tubular core 2 and thereafter expanded to grip the core for winding a web of sheet material, such as paper or film.

The mandrel is particularly useful in mounting cores for master roll production and for on and off line slitting in film winding operations. The precision runout feature leads directly to both improved yields and quality. Similar levels of runout probably can be achieved by other mechanical means, but the combination of precision, light weight and design simplicity are unique to this design.

Referring again to FIG. 1, it will be seen that a pair of abutting inner and outer tapered elements are mounted in spaced relationship with each other at the opposite ends of a tube 3.

The inner elements 4 each have a first cylindrical inner surface 5 and a second tapered outer surface 6. The first surfaces 5 of these elements are positioned in slidable contact with the outer cylindrical surface 7 of the tube 3.

The outer tapered elements 8, which are positioned in abutting contact with these elements 4, have a first cylindrical outer surfaces 9 and a second tapered inner surface 10. These second tapered surfaces 10 are positioned in operative sliding relationship with the second tapered surfaces 6 of such inner elements 4 and such outer elements 8 are adapted to be expanded outwardly so that their outer cylindrical surfaces 9 contact and grip the inner cylindrical surface 11 of the core 2.

During assembly, the outer elements 8 are positioned onto the tube 3 first and are brought into their final axial positions with respect to such tube. Stop collars 12 are provided to limit the inward axial movement of these elements 8 and a pin 13 is inserted through an aperature in such elements to limit both their outward axial movement and to prevent them from rotating. These features play a significant role in the operation of the mandrel of this invention and assures that the outer memebers only move or expand radially outwardly during mounting.

An alternate approach of fixing the inner tapered elements and driving the outer ones also would work but not as well. It would tend to cause axial motion of the core during mounting. And during core release, more torque would be required to overcome friction between the core and moving outer elements.

The inner elements 4 are then positioned onto the tube 3 with their tapered surfaces 6 in abutting contact with the tapered surfaces 10 of the outer elements 8. These elements 4 are adapted to be moved axially inwardly, simultaneously, to cam the spring-like outer elements 8 radially outwardly to their core gripping positions. These elements 8 are appropriately slotted alternately from opposite ends to permit this radial expansion to take place. Expansion of such outer elements is further enhanced by cutting slots lengthwise through approximately 90% of their length starting at alternating ends. This allows diametrical growth on the order of 0.30 inches or more which is adequate to adjust to internal diameter (ID) variations on commercially available cores. Multiple elements are used as required to fix the core to the mandrel along its length. Typically only two are required due to the intimate contact made with each expanding element.

As best seen in FIG. 1, the means for moving the inner elements 4 axially inwardly is in the form of a floating acme screw generally designated 14. Such screw comprises a through shaft 15 having right hand threads 16 on one end and left hand threads 17 on the other end. A first acme nut 18 is positioned on the right hand screws and a second acme nut 19 is positioned on the left hand screws. These acme nuts are appropriately connected to drive discs 20 which, in turn, are connected by pins or screws to the inner tapered elements 4.

A drive nut 21 is positioned on the end of the shaft 15. By turning this nut clockwise the inner tapered elements 4 may be moved simultaneously inwardly toward each other. As they move under, and in sliding contact with, the outer tapered elements 8, such outer elements are expanded radially outwardly, in a uniform manner, into gripping contact with the inner surface 11 of the core 3.

This uniform movement of the outer elements 8 is accomplished by selecting the proper angle of taper of the tapered surfaces, 6 and 10, of the inner and outer elements. Specifically, such angle, for uniform movement of the outer elements, must not exceed 45° from the horizontal and, preferably, such angle is less than 20°.

At angles of less than 20° from the horizontal not only will the outer elements 8 be cammed outwardly in a uniform manner, with their cylindrical outer surfaces 9 remaining in a substantially horizontal plane, both during movement and at the time of contact with the inner cylindrical surface 11 of the core 3, but it has been found that in the mandrel of this invention, at this angle, the frictional contact of such tapered surfaces lock the inner elements 4 in position axially. This is an important attribute of the instant invention.

Additionally, supporting or dual locking capabilities are realized for the inner elements 4 by the tension created by the floating acme screw 14. This dual locking feature is also a significant aspect of the invention.

The floating acme screw 14, in combination with the acme nuts on the right and left hand screws of the screw shaft, also bring about a still further important operational feature of the mandrel 1. This screw permits the application of substantially equal forces to be brought against the core 3 by the outer elements 8, irrespective of the core diameter at the position or area of contact.

Mandrels with two or more elements for gripping a core require that the means for moving the inner tapered elements be able to adjust to changes in the core ID. Paper cores have significant variations in core ID from core-to-core and along the length of a given core. If the inner elements are driven by a fixed mechanical device, such as a fixed acme screw, one element will contact the core before the other and all or most of the locking force will go into that end. The other end will not have a tight fit between the expanding element and core and excessive runout can result. This can be solved by several methods. Individual air or hydraulic cylinders extended using the same high pressure supply can be used to expand the several elements. The force going into each element will be equal under these conditions and all of the elements will grip evenly. However, the expense, space constraints and weight associated with mounting multiple air cylinders in a mandrel is a problem.

The solution to this problem is the floating acme screw 14. Here, inner element pairs are driven using a single acme screw with two nuts 18 and 19. Each nut is attached to one inner element through slots in the support tube 3. The acme screw has right hand threads for one element and left hand ones for the other. As the screw is turned the inner elements 4 are configured so that they move toward each other and expand the outer tapered element 8 which are fixed axially. The opposite direction can be employed but the expansion load would result in compression rather than tension in the acme screw. Since acme screws are slender, tension is the preferred load carrying mechanism. The acme screw 14 is not fixed in the axial direction so that the tension in the screw between elements is the only axial force to drive the inner tapered elements 4. Therefore, each element sees the same expanding force regardless of its radial growth. If desired the acme screw may be axially centered by springs to insure smooth radial expansion. The result is a less expensive and lighter means for expanding the elements that has the ability to adjust to changes in the core ID along its length. An alternate approach which works for more than two elements would employ a spring mount between the acme nut and the inner tapered elements.

Figure 3:
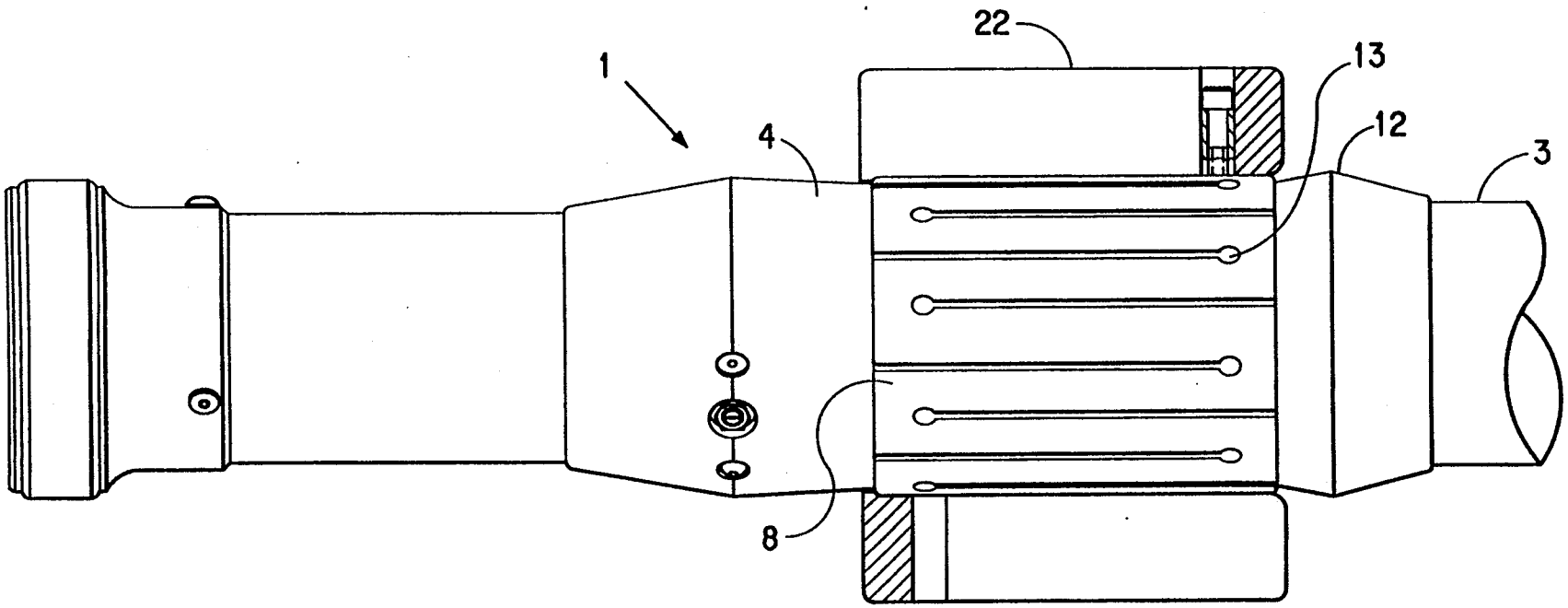
FIG. 3 is a plane view showing a mandrel of the invention, with parts broken away, with an adapter bushing in position to be expanded outwardly to grip a core.

Normally different mandrels are required for each core ID that is employed. Core diameters are set by customer requirements and a variety of core ID's are used. As shown in FIG. 3, an adapter bushing 22 can be used with the mandrel of this invention to make it fit a variety of cores. The procedure followed is to design a basic mandrel to fit the smallest core used and to provide cylindrical bushings to increase the expanding element OD to fit the larger cores. The bushing 22 for accomplishing this purpose is a cylindrical tube segment approximately the same length as the outer expanding element. It uses the same alternating saw cut pattern to enhance radial expansion and an anti-rotation pin 13 is added to eliminate slipping. Bushings to adapt to cores two or more inches larger than the standard are made of plastic to conserve weight. This bushings should be made of metal to avoid problems caused by low strength or warping during fabrication. A properly fabricated bushing adds no appreciable TIR to the mounted core.

Both the outer tapered element and the bushing can be remachined to correct for any loss in concentricity caused by wear or damage. The assembled mandrel is mounted in a lathe with the locking elements expanded. A small layer of material is removed from the outer surface of the expanded elements. This brings the mandrel OD back to near perfect concentricity. The same approach works for a mandrel fitted with a bushing.

Extremely low total indicated runouts (TIR) are achieved using this mandrel. Typically the TIR of the expanded mandrel is less than 1 mil. When commercial cores are mounted, runouts are typically below 10 mils and this stays constant through the winding process. For the standard air bladder design, typical runouts are in access of 25 mils and the magnitude of the runout tends to change during winding in an unpredictable manner. This precision is achieved by two key factors. First, the expanding elements as described above provide extremely true expansions for mounting the cores. Since they are solid and held in position axially, the mounting stays constant through the entire winding process. Air in the standard bladder design is free to move about and will frequently do so as the combinations of weight and layon roll forces introduce loads on the core. Second, the buildup of fabrication tolerances is eliminated by the final machining operation during assembly. The assembled mandrel is mounted in a lathe with the elements expanded. The expanded elements are then machined to their final dimension and the low TIR is achieved.

What is claimed is:

1. A mandrel for mounting a tubular core for winding a web of sheet material, such mandrel being slidably positioned into the core and including:

a tube having an inner and outer cylindrical surface;

a pair of inner tapered elements positioned in spaced relationship with each other on the outer surface of the tube, such inner elements each having a first cylindrical inner surface, a second tapered outer surface and an angle of taper therebetween, with such first inner surfaces being positioned in slidable contact with the outer cylindrical surface of the tube, a pair of expandable outer tapered elements positioned in spaced relationship with each other in the axial direction and each in abutting contact with a respective inner element, such outer elements each having a first cylindrical outer surface and a second tapered inner surface, with each of said second tapered surfaces being positioned in operative relationship with a respective second tapered outer surface of one of said inner elements and with the outer elements being adapted to be expanded outwardly, means for connecting the inner and outer elements to the tube and means for restricting the axial and rotational movement of the outer elements with respect to the tube, said core having an inner and outer cylindrical surface, means in the form of a floating screw connected to the inner elements for moving such inner elements axially inwardly toward each other whereby sliding contact of the tapered outer surface of such inner elements with the tapered inner surfaces of the outer elements expands the outer elements radially outwardly in a uniform manner and moves their cylindrical outer surfaces into uniform contact with the inner surface of the core whereby to grip and mount the core for winding and wherein such floating screw is also adapted to move the inner elements away from each other to release the gripping force of the outer elements with the core so that the mandrel can be removed from the core after completion of the winding operation.

2. The mandrel of claim 1 wherein the means for moving the inner elements inwardly toward each other is a single floating screw not fixed in the axial direction, such screw comprising a through shaft having right hand threads at one end and left hand threads at the other end, a first nut positioned on the right hand threads and a second nut positioned on the left hand threads, such first nut being connected to one of the inner elements and such second nut being connected to the other inner element, whereby when such screw is rotated in one direction, the spaced apart inner elements are moved simultaneously axially toward each other thereby expanding the outer elements radially outwardly into gripping contact with the inner surface of the core.

3. The mandrel of claim 2 wherein the angle of taper of the second outer surfaces of the inner tapered elements in slidable contact with the second inner surfaces of the outer tapered elements is less than 20°, whereby such outer elements are cammed outwardly uniformly with their cylindrical outer surfaces remaining substantially parallel to said inner cylindrical surfaces of said core during movement and during contact with the inner surface of the core and whereby the floating screw provides substantially equal gripping forces, by each of the outer elements, with the core and an additional locking force for maintaining the inner and outer elements in their axial positions during a web winding operation.

4. The mandrel of claim 1 wherein the angle of taper of the second outer surfaces of the inner tapered elements in slidable contact with the second inner surfaces of the outer tapered elements is less than 45° whereby such outer elements are cammed outwardly uniformly with their cylindrical outer surfaces remaining substantially parallel to said inner cylindrical surface of said core during movement and during contact with the inner surface of the core.

5. The mandrel of claim 1 wherein the angle of taper of the second outer surfaces of the inner tapered elements in slidable contact with the second inner surfaces of the outer tapered elements is less than 20°, whereby such outer elements are cammed outwardly uniformly with their cylindrical outer surfaces remaining substantially parallel to said inner cylindrical surface of said core during movement and during contact with the inner surface of the core.

6. The mandrel of claim 1 including a metal bushing positioned over each expandable outer element for adapting the mandrel to fit a specific core diameter wherein slipping of such bushing relative to said mandrel is eliminated by an anti-rotation pin on said bushing and wherein the expansion of the outer elements moves the outer surfaces of the bushings into gripping contact with the inner surface of the core whereby to grip and mount the core for winding.

* * * * *